US005367760A

United States Patent [19]

Terlop et al.

[11] Patent Number: 5,367,760

[45] Date of Patent: Nov. 29, 1994

[54] METHOD OF MAKING A NARROW PROFILE TRANSFORMER

[76] Inventors: William E. Terlop, 25269 Bunting Cir., Land O Lake, Fla. 34639; Serge Casagrande, 1318 Norwick Dr., Lutz, Fla. 33549

[21] Appl. No.: 52,499

[22] Filed: Apr. 26, 1993

[51] Int. Cl.[5] ..... H01F 4/06

[52] U.S. Cl. ..... 29/605; 29/606; 336/60; 336/183

[58] Field of Search ..... 29/605, 606; 336/60, 336/195, 182, 183

[56] References Cited

U.S. PATENT DOCUMENTS 3,728,655 4/1973 Reinke .

*Primary Examiner*—Carl E. Hall

[57] ABSTRACT

An improved narrow profile transformer and method of making is disclosed comprising a primary winding and a secondary winding with the secondary winding being interleaved with the primary winding. The primary and secondary windings are spiral winding with all portions of the primary and secondary windings intersecting a geometric plane extending through the narrow profile transformer. The primary and secondary windings of the narrow profile transformer may be encapsulated within a polymeric material.

5 Claims, 8 Drawing Sheets

METHOD OF MAKING A NARROW PROFILE TRANSFORMER

BACKGROUND OF THE INVENTION

1. Field Of The Invention

This invention relates to transformers and more particularly to a transformer having a narrow profile for operation with an extremely high secondary winding current.

2. Background Of The Invention

In the prior art, there are many types of transformers which have been designed for specific requirements of an electrical load. In many applications, a transformer must be specifically designed to meet certain physical space constraints while being able to provide the required power output to the electrical load. One example of a transformer specifically designed to meet certain physical space constraints is a narrow profile transformer. A narrow profile transformer has secondary winding output adapted to be received in a very narrow space and has the general appearance of a rectangular or square book.

In one example of an application for a narrow profile transformer is the connection of the secondary winding to an inductive electrical load. In this example, an inductor load comprising one or more turns is connected to the secondary winding of the narrow profile transformer for inductively heating a metallic part. The inductive heating of the metallic part is useful for heat treating the metallic part such as a bearing surface of the metallic part or the like. A series of narrow profile transformers can be placed in a side by side relationship for simultaneously induction heating a plurality of different bearing surfaces located on a long shaft such as the bearing surfaces of a crankshaft of an engine. The advantage of simultaneously induction heating a plurality of different bearing surfaces of a crankshaft of an engine should be readily appreciated by those skilled in the art.

U.S. Pat. No. 3,728,655 to Reinke discloses a narrow profile transformer that have been used extensively over the years for the simultaneous induction heating of all bearing surfaces of a crankshaft of an engine. Although the narrow profile transformer disclosed in U.S. Pat. No. 3,728,655 has been widely used in the industry, this transformer has many disadvantages. A primary disadvantage of the narrow profile transformer disclosed in U.S. Pat. No. 3,728,655 is the orientation of the secondary winding being interposed between two primary windings with the primary windings being connected electrically in series with one another. Accordingly, the narrow profile transformer disclosed in U.S. Pat. No. 3,728,655 suffered from high resistance and high leakage or stray inductance.

U.S. Pat. No. 2,862,195 to Kury discloses a transformer with a primary winding and a secondary winding being disposed in a side by side relationship. This configuration of the primary and secondary windings similarly suffered from high resistance and high leakage or stray inductance.

Therefore, it is an object of the present invention to provide an improved narrow profile transformer with reduced resistance and reduced leakage or stray inductance.

Another object of this invention is to provide an improved narrow profile transformer with interleaved primary and secondary windings.

Another object of this invention is to provide an improved narrow profile transformer with a reduced width to make the narrow profile transformer as thin as possible.

Another object of this invention is to provide an improved narrow profile transformer wherein the primary winding is radially spirally wound with all portions of the primary winding intersecting a geometric plane extending through the improved narrow profile transformer.

Another object of this invention is to provide an improved narrow profile transformer wherein the secondary winding comprises a plurality of secondary turn elements being interleaved with the primary winding with all portions of the secondary winding intersecting the geometric plane extending through the improved narrow profile transformer.

Another object of this invention is to provide an improved narrow profile transformer with a reduced overall resistance of the primary winding and the secondary winding.

Another object of this invention is to provide an improved narrow profile transformer with the primary and secondary windings comprising conduits for directing the flow of a fluid coolant therethrough for cooling the primary and secondary windings.

Another object of this invention is to provide an improved narrow profile transformer incorporating a ferrite core for reducing core losses in the narrow profile transformer.

Another object of this invention is to provide an improved narrow profile transformer incorporating a ferrite core placed in relation to the primary and secondary windings enabling the fluid cooled primary and secondary windings to cool the ferrite core thus eliminating the need to independently cool the ferrite core.

Another object of this invention is to provide an improved narrow profile transformer which is encapsulated with a polymeric material for mechanically securing the primary and secondary windings relative to the core and for protecting the primary and secondary windings and the core.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved narrow profile transformer for transferring electric power from an electrical power source to an electrical load. The improved narrow profile transformer comprises primary winding means being spirally wound with all portions of the primary winding means intersecting a geometric plane extending through the improved narrow profile transformer. Secondary winding means is interleaved with the primary winding means with all portions of the secondary winding means intersecting the geometric plane. Insulation means is interposed between the primary winding means and the secondary winding means. A transformer core inductively couples the primary winding means to the secondary winding means. Input connection means electrically connects the primary winding means to the electrical power source whereas output connection means electrically connects the secondary winding means to the electrical load. The secondary winding means is secured relative to the primary winding means for maintaining the relative position therebetween.

In a more specific embodiment of the invention, the primary winding means is spirally wound radially outwardly with all portions of the primary winding means intersecting the geometric plane extending through the improved narrow profile transformer. The secondary winding means includes a plurality of secondary turn elements with shunt means interconnecting the plurality of secondary turn elements in a parallel relationship. The insulation means comprises a polymeric coating affixed to at least one of the primary winding means and the secondary winding means.

In one embodiment of the invention, the primary and second winding means are encapsulated within a polymeric material for maintaining the relative position therebetween. The transformer core comprises a ferrite core for inductively coupling the primary winding means to the secondary winding means.

In another embodiment of the invention, the primary winding means comprises primary metallic conducting tube means defining a primary fluid passage within the primary metallic conducting tube means. The secondary winding means comprises secondary metallic conducting tube means defining a secondary fluid passage within the secondary metallic conducting tube means. The primary and secondary metallic conducting tube means are connected to a source of flowing fluid for cooling the improved narrow profile transformer thereby. Preferably, the ferrite core is located in close proximity to the primary and secondary winding means for cooling the ferrite core thereby.

The invention is also incorporated into the method of forming an improved narrow profile transformer comprising positioning an elongated spacer between a primary winding material and a secondary winding material. The spirally winding the primary winding material, the elongated spacer the secondary winding material within a geometric plane to form a primary winding means from the primary winding material and to form a secondary winding means from the secondary winding material with the secondary winding means being interleaved with the primary winding means. The elongated spacer and the secondary winding means is removed and the secondary winding means is severed to form a plurality of secondary turn means. The plurality of secondary turn means are connected to form the secondary turn means. Input connection means is connected to the primary winding means and output connection means is connected to the secondary winding means. An insulation is provided between the primary winding means and the secondary winding means.

The secondary winding means is inserted into the primary winding means with the secondary winding means being interleaved within the primary winding means. The secondary winding means is secured relative to the primary winding means.

In a more specific embodiment of the method of the invention, the primary winding material, the elongated spacer the secondary winding material is spirally wound radially outwardly such that all portions of the primary winding material, the elongated spacer the secondary winding material intersect the geometric plane extending through the improved narrow profile transformer. The insulation provided between the primary winding means and the secondary winding means may includes affixing a polymeric coating to at least one of the primary winding means and the secondary winding means. The secondary winding means may be secured relative to the primary winding means by encapsulating the primary and second winding means within a polymeric material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
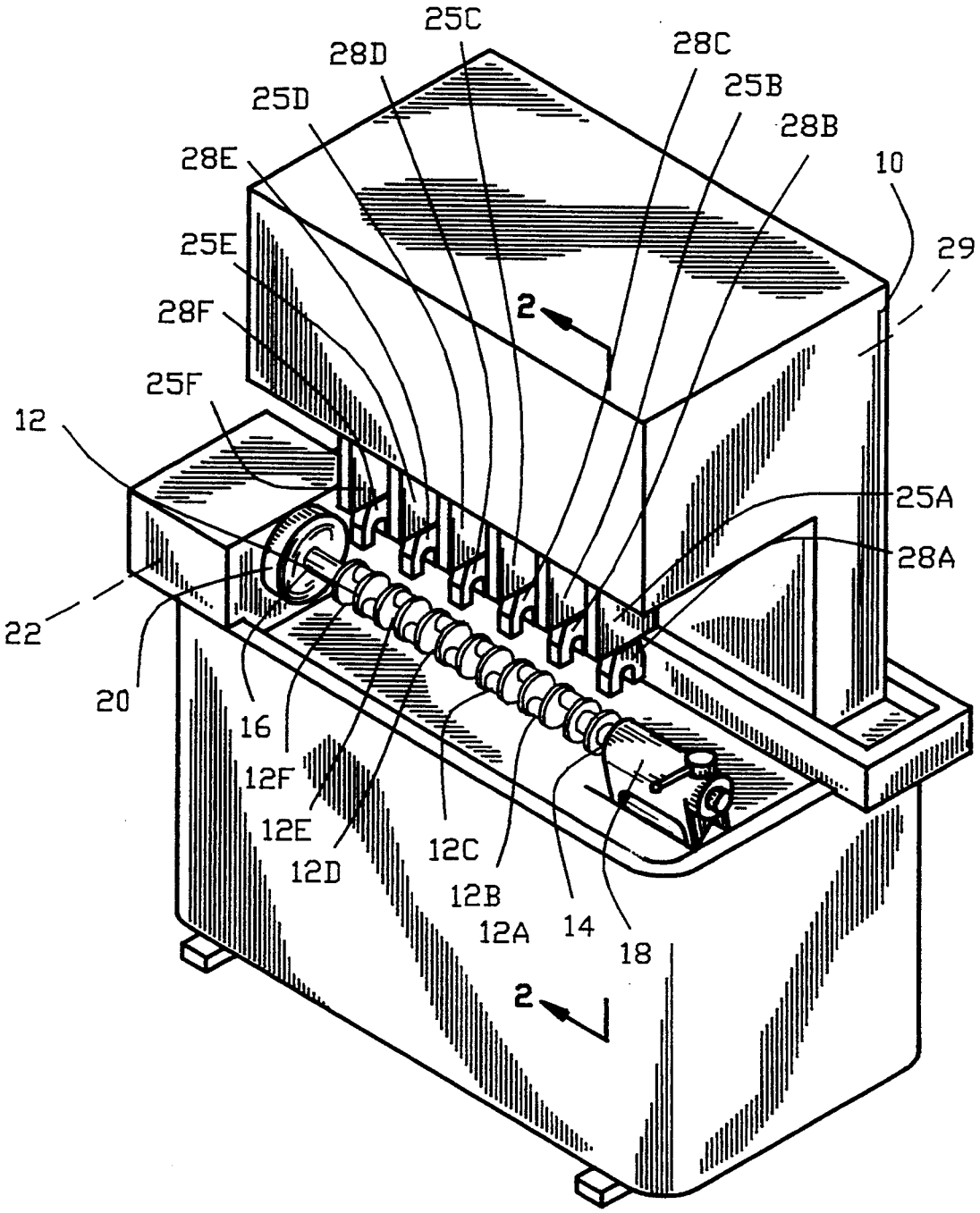
FIG. 1 is an isometric view of an apparatus incorporating a plurality of narrow profile transformers of the present invention for induction heat hardening of a crankshaft for an engine.

FIG. 1 is an isometric view of an apparatus 10 for induction heat hardening of a crankshaft 12 for an engine such as an automobile or truck engine (not shown). The crankshaft 12 comprises a plurality of cylindrical bearing surfaces 12A–12F located between a first and a second crankshaft end 14 and 16. In order to extend the useful life of the plurality of cylindrical bearing surfaces 12A–12F, it is customary in the prior art to heat treat harden the entirety of the cylindrical bearing surfaces 12A–12F. The cylindrical bearing surfaces 12A–12F may comprise connecting rod bearing surfaces, thrust collars, fillets, seal seats and the like.

The first crankshaft end 14 is supported by a supporting spindle 18 whereas the second crankshaft end 16 is supported by a powered spindle 20 driven by a motor 22. The motor 22 rotates the crankshaft 12 upon the spindles 18 and 20 for enabling the induction heating of the entirety of the plurality of cylindrical bearing surfaces 12A–12F.

The apparatus 10 comprises a plurality of narrow profile transformers 25A–25F respectively connected to inductive loads 28A–28F. The plurality of narrow profile transformers 25A–25F are each independently pivotably mounted to the apparatus 12 upon a balanced moving platform (not shown). The plurality of narrow profile transformers 25A–25F are connected to an electrical power source 29 internal the apparatus 10. The independent and pivotal mounting of the plurality of narrow profile transformers 25A–25F are about an axis extending parallel to an axis rotational axis of the spindles 18 and 20. The balanced moving platform (not shown) can be raised or lowered enabling the inductors 28A–28F to be lowered onto the plurality of cylindrical bearing surfaces 12A–12F of the crankshaft 12.

The independent pivotable mounting of the plurality of narrow profile transformers 25A–25F enables the inductive loads 28A–28F to maintain in contact with and to inductively heat the entirety of the plurality of cylindrical bearing surfaces 12A–12F as the crankshaft is rotated on the spindles 18 and 20. The apparatus 10 permits the simultaneous induction heating of the entirety of the plurality of cylindrical bearing surfaces 12A–12F in a single operation.

Figure 2:
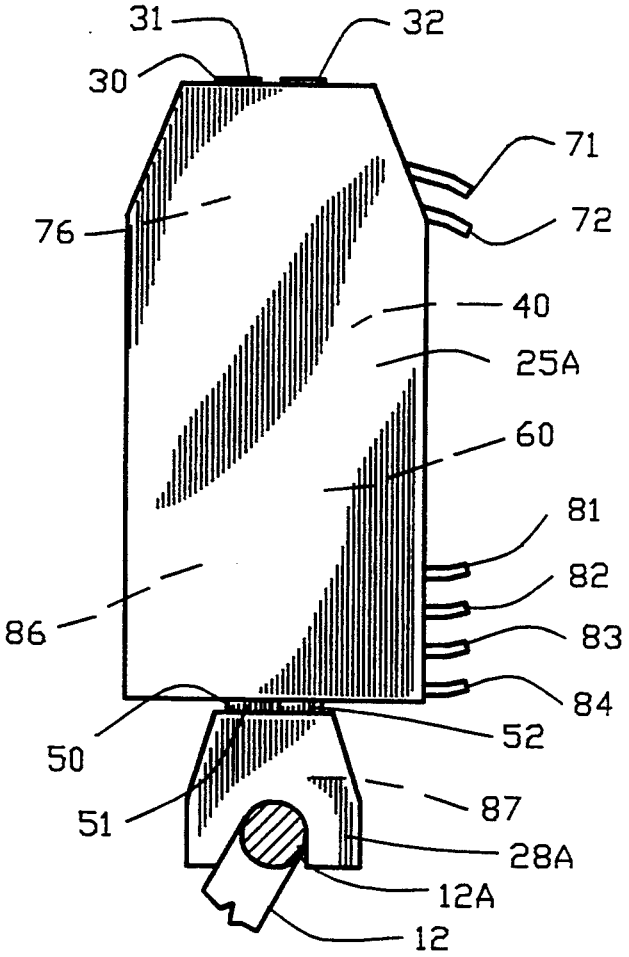
FIG. 2 is a sectional view along line 2—2 in FIG. 1 illustrating the narrow profile transformer connected to a load.
Figure 3:
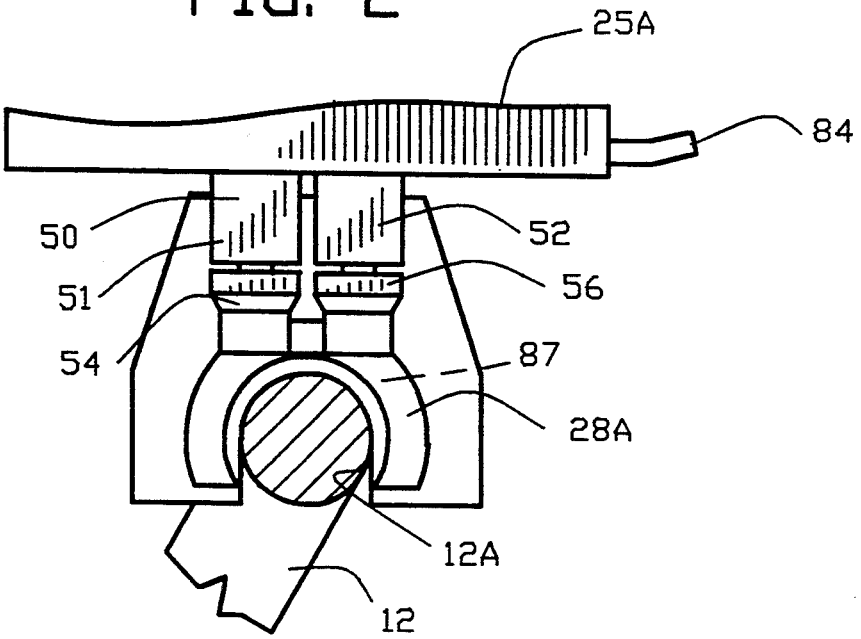
FIG. 3 is an enlarged partial view of FIG. 2 partially in section illustrating the load connected to the narrow profile transformer.

FIG. 2 is a sectional view along line 2—2 in FIG. 1 illustrating the narrow profile transformer 25A connected to the inductive load 28A. FIG. 3 is an enlarged partial view of FIG. 2 partially in section illustrating the load 28A connected to the narrow profile transformer 25A. The inductor 28A is shown as a semi-open inductor wrapped about a portion of the cylindrical bearing surface 12A of the crankshaft 12. The semi-open inductor 28A is shaped so that only a portion of the entire cylindrical bearing surface 12A is heated at a given instant of time. As the crankshaft is rotated on the spindles 18 and 20, the entirety of the plurality of cylindrical bearing surfaces 12A–12F are simultaneously and independently heated to a preset temperature. When the plurality of cylindrical bearing surfaces 12A–12F are heated to the preset temperature, the crankshaft 12 is submerged and quenched in a bath of fluids to harden the plurality of cylindrical bearing surfaces 12A–12F.

Figure 7:
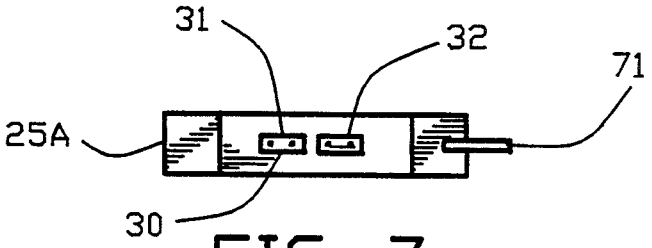
FIG. 7 is a top view of FIG. 4.
Figure 5:
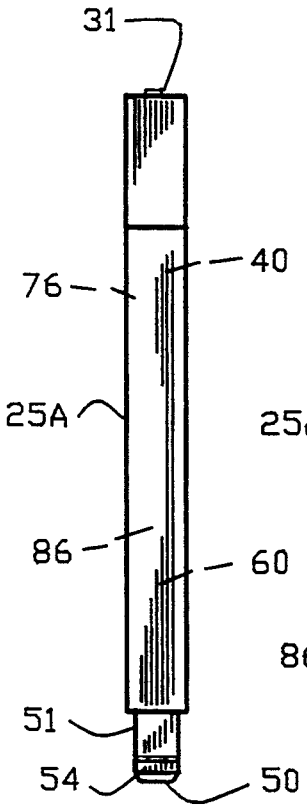
FIG. 5 is a left end view of FIG. 4.
Figure 4:
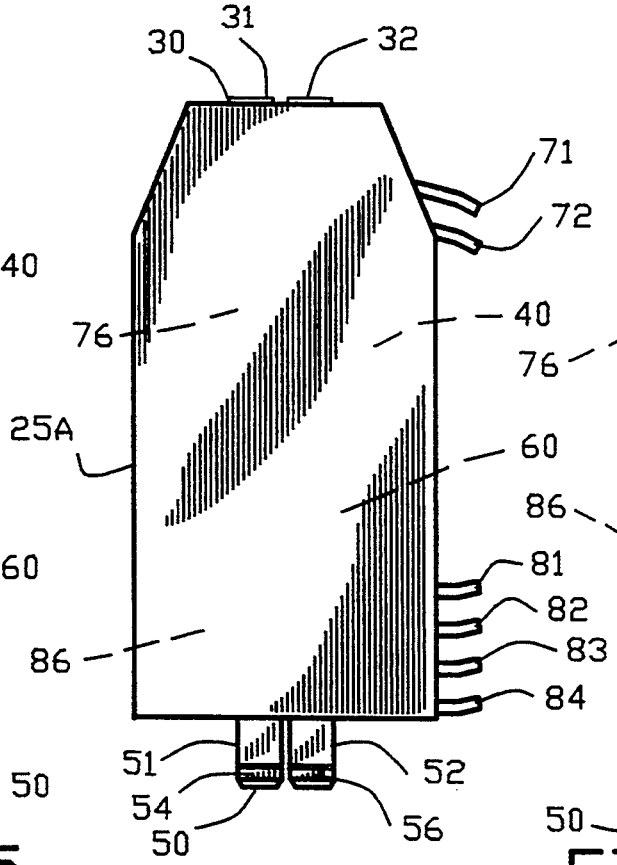
FIG. 4 is a side view of the narrow profile transformer of the present invention.
Figure 6:
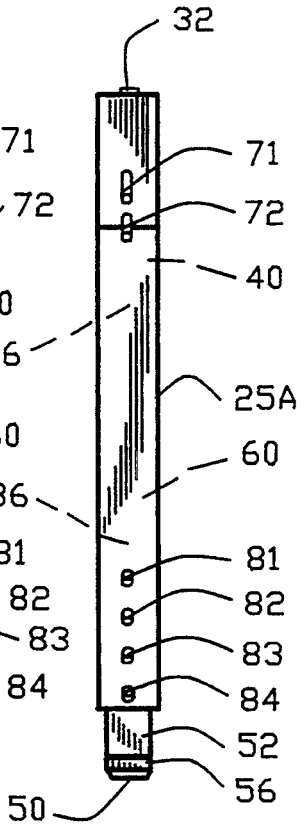
FIG. 6 is a right end view of FIG. 4.
Figure 8:
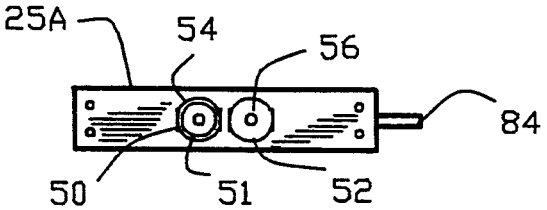
FIG. 8 is a bottom view of FIG. 4.

FIG. 4 is a side view of the narrow profile transformer 25A with FIGS. 5 and 6 being left and right end views and with FIGS. 7 and 8 being top and bottom views thereof. The narrow profile transformer 25A includes input connection means 30 comprising a first and a second input terminal 31 and 32 for connection to the electrical power source 29. The first and second input terminals 31 and 32 are connected to a primary winding means 40 disposed internal the narrow profile transformer 25A.

The narrow profile transformer 25A includes output connection means 50 comprising a first and a second output terminal 51 and 52 for connection to the electrical load 28A shown in FIGS. 1–3. The first and second output terminals 51 and 52 are connected to a secondary winding means 60 disposed internal the narrow profile transformer 25A. The first and second output terminals 51 and 52 may include quick clamping connectors 54 and 56 for rapidly securing and removing the electrical load 28A to the narrow profile transformer 25A.

Preferably, the narrow profile transformer 25A is constructed for medium frequency operation such as 10 KHz. with an input voltage of 800 volts and a power rating of 750 KVA. The secondary winding means 60 typically produces an output current to the electrical load 28A of 7500 amperes at a voltage of 100 volts. The medium frequency operation of the narrow profile transformer 25A substantially reduces the physical size of the transformer relative to a transformer of a comparable power rating operating at a low frequency such as 50 Hz to 60 Hz.

The operating power rating of the narrow profile transformer 25A requires cooling due in part to the skin effect and the eddy currents generated by the medium frequency operation of the narrow profile transformer 25A. As will be described in greater detail hereinafter, the narrow profile transformer 25A is provided with primary cooling tubes 71 and 72 connected to a primary fluid passage 76 for cooling the primary winding means 50 through a flowing fluid such as a flowing liquid. Secondary cooling tubes 81–84 are connected to a secondary fluid passage 86 for cooling the secondary winding means 60 and the output connection means 50 through a flowing fluid such as a flowing liquid. The secondary cooling tubes 83 and 84 are connected to a load fluid path 87 through the quick clamping connectors 53 and 54 for cooling the electrical load 28A.

Figure 10:
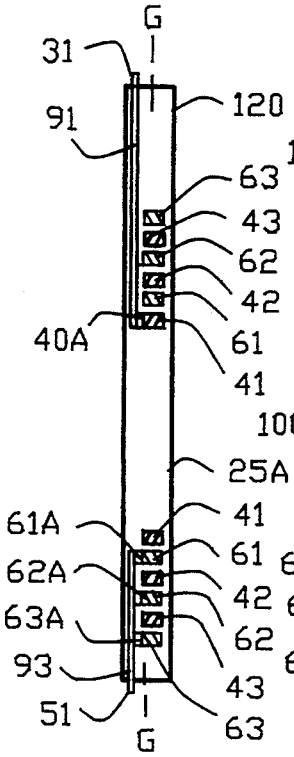
FIG. 10 is a sectional view along line 10—10 in FIG. 9.
Figure 9:
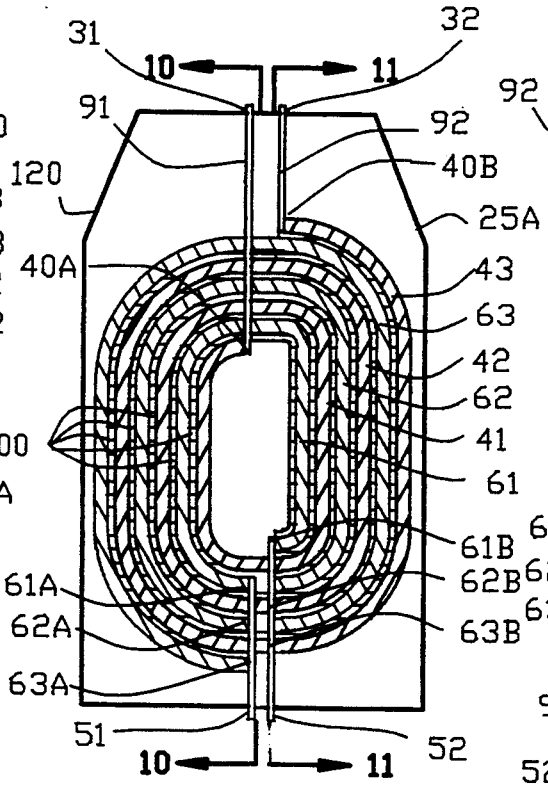
FIG. 9 is a side sectional view of the narrow profile transformer of FIG. 4 illustrating a primary and a secondary winding.
Figure 11:
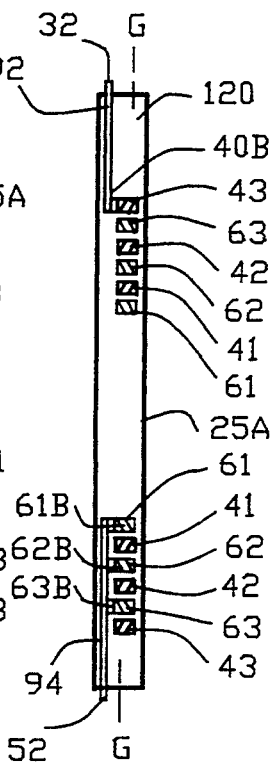
FIG. 11 is a sectional view along line 11—11 in FIG. 9.

FIG. 9 is a side sectional view of the narrow profile transformer 25A of FIG. 4 illustrating the primary and secondary winding means 40 and 60. FIG. 10 is a sectional view along line 10—10 in FIG. 9 whereas FIG. 11 is a sectional view along line 11—11 in FIG. 9 illustrating only the sectional portions of the primary and secondary winding means 40 and 60.

The primary winding means 40 is spirally wound to define a plurality of primary turn elements shown as a first, second and third primary turn means 41–43. The primary winding means 40 is spirally wound radially outwardly with all portions of the first, second and third primary turn means 41–43 intersecting a geometric plane G extending through the improved narrow profile transformer 25A as shown in FIGS. 10 and 11.

Figure 12:
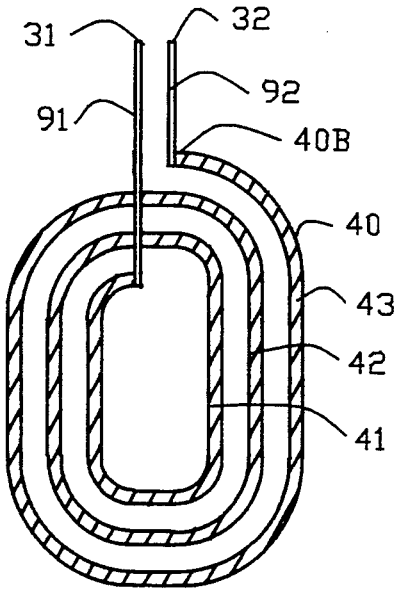
FIG. 12 is a side sectional view illustrating the primary winding of the narrow profile transformer of FIG. 9.

FIG. 12 is a side sectional view illustrating the primary winding 40 of the narrow profile transformer 25A of FIG. 9. The primary winding means 40 comprises a first primary end 40A and a second primary end 40B respectively connected to the first and second input terminals 31 and 32 through first and second input bus bars 91 and 92.

Figure 13:
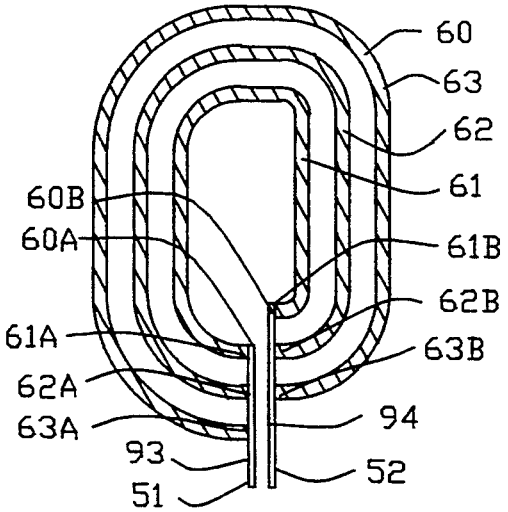
FIG. 13 is a side sectional view illustrating the secondary winding of the narrow profile transformer of FIG. 9.

FIG. 13 is a side sectional view illustrating the secondary winding 60 of the narrow profile transformer 25A of FIG. 9. The secondary winding means 60 is spirally wound to define a plurality of secondary turn elements shown as a first, second and third secondary turn means 61–63. The secondary winding means 60 is spirally wound radially outwardly with all portions of the first, second and third secondary turn means 61–63 intersecting the geometric plane G extending through the improved narrow profile transformer 25A as shown in FIGS. 10 and 11. The plurality of secondary turn elements 61–62 are interleaved with the plurality of primary turn means 41–43.

The first, second and third secondary turn means 61–63 of the secondary winding means 60 are severed for defining first, second and third turn elements having first secondary turn ends 61A–63A and secondary turn ends 61B–63B. The first secondary turn ends 61A–63A are interconnected by a shunt means comprising a first output bus bar 93 to define a first secondary end 60A. The second secondary turn ends 61B–63B are interconnected by a shunt means comprising a second output bus bar 94 to define a second secondary end 60B. The first secondary end 60A and the second secondary end 60B are connected by the first and second output bus bars 93 and 94 to the first and second output terminals 51 and 52.

The first and second output bus bars 93 and 94 interconnect the plurality of secondary turn means 61–63 in a parallel relationship. The plurality of secondary turn means 61–63 interconnected in a parallel relationship provides a step down transformer for accommodating the high output current required by the electrical load 28A. However, it should be appreciated by those skilled in the art that the narrow profile transformer 25A of the present invention may be constructed as a step up transformer by severing the primary winding means 40.

Insulation means 100 is interposed between the primary winding means 40 and the secondary winding means 60 for providing electrical insulation therebetween. Preferably, the insulation means 100 comprises a polymeric coating such as vinyl or similar type coating affixed to the primary winding means 40 and/or the secondary winding means 60. The polymeric coating of insulation 100 may be affixed to the primary winding means 40 and/or the secondary winding means 60 by a fluidized bed coating process, electrostatic coating process or the like. A transformer core as will be discussed in greater detail with reference to FIGS. 24 and 25, inductively couples the primary winding means 40 to the secondary winding means 60.

The secondary winding means 60 is secured relative to the primary winding means 40 by encapsulating the primary and second winding means 40 and 60 within a polymeric material 120 for maintaining the relative position therebetween. The polymeric material 120 secures all portions of the primary and second winding means 40 and 60 into an integral composite structure. The integral composite structure of the narrow profile transformer 25A maintains the integrity and alignment of the primary and second winding means 40 and 60 when the narrow profile transformer 25A is subjected to movement and vibration during the operation of the apparatus 10. The integral composite structure of the narrow profile transformer 25A protects the primary and secondary winding means 40 and 60 as well as the transformer core.

Figure 14:
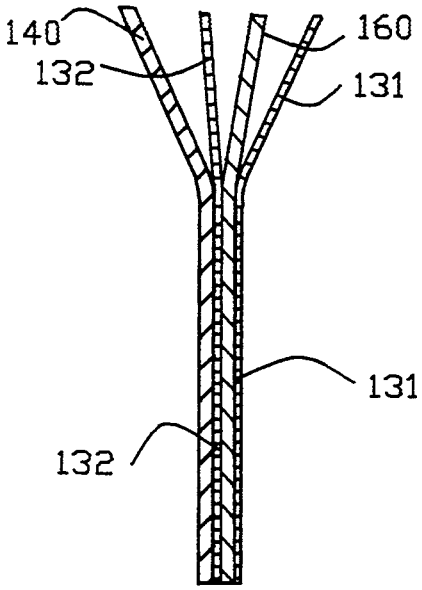
FIG. 14 is a first step in the method of fabricating the narrow profile transformer illustrating the positioning of elongated spacers between a primary winding material and a secondary winding material.
Figure 15:
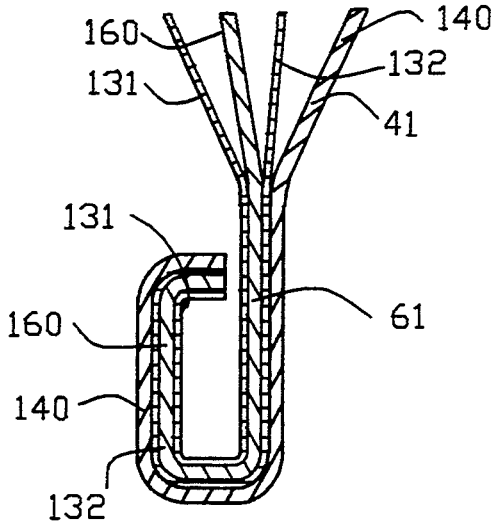
FIG. 15 is a second step in the method of fabricating the narrow profile transformer illustrating the spiral winding of the primary winding material, the elongated spacers and the secondary winding material to form a first turn of the primary and the second windings.

FIG. 14 is a first step in the method of fabricating the narrow profile transformer 25A shown in FIGS. 1–13. The method comprises the steps of positioning a first and a second elongated spacer 131 and 132 between a primary winding material 140 and a secondary winding material 160. The first and second elongated spacers 131 and 132 may be flat rubber or other similar material having a width commensurate with the width of the primary and secondary winding materials 140 and 160. The thickness of the first and second elongated spacers 131 and 132 are selected to accommodate for insulation required between the primary and secondary windings 40 and 60, FIG. 15 is a second step in the method of fabricating the narrow profile transformer 25A illustrating the spiral winding of the primary winding material 140, the elongated spacers 131 and 132 and the secondary winding material 160 to form the first turns 41 and 61 of the primary and the secondary windings 40 and 60.

Figure 16:
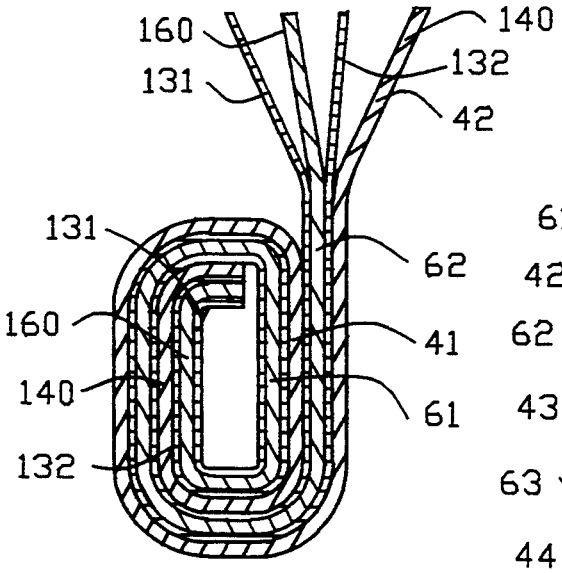
FIG. 16 is a third step in the method of fabricating the narrow profile transformer illustrating the spiral winding of the primary winding material, the elongated spacers and the secondary winding material to form a second turn of the primary and secondary windings.

FIG. 16 is a third step in the method of fabricating the narrow profile transformer 25A illustrating the spiral winding of the primary winding material 140, the elongated spacers 131 and 132 and the secondary winding material 160 to form the second turns 42 and 62 of the primary and secondary windings 40 and 60.

Figure 17:
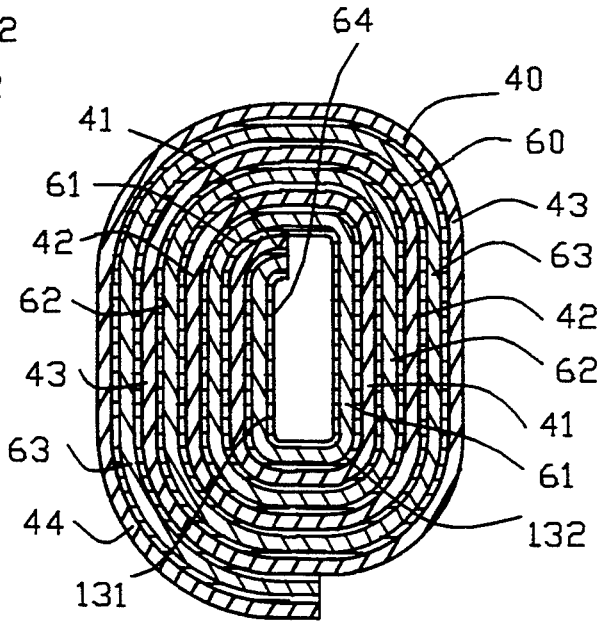
FIG. 17 is a fourth step in the method of fabricating the narrow profile transformer illustrating the spiral winding of the primary winding material, the elongated spacers and the secondary winding material to form a third turn of the primary and secondary windings.

FIG. 17 is a fourth step in the method of fabricating the narrow profile transformer 25A illustrating the spiral winding of the primary winding material 140, the elongated spacers 131 and 132 and the secondary winding material 160 to form the third turns 43 and 63 of the primary and secondary windings 40 and 60. The primary winding material 140, the elongated spacers 131 and 132 and the secondary winding material 160 are radially outwardly spirally wound within the geometric plane G to form the primary winding means 40 from the primary winding material 140 and to form the secondary winding means 60 from the secondary winding material 160. The secondary winding means 60 is interleaved with the primary winding means with all portions of the primary winding material 140, the elongated spacers 131 and 132 and the secondary winding material 160 intersecting the geometric plane G extending through the improved narrow profile transformer 25A.

Figure 18:
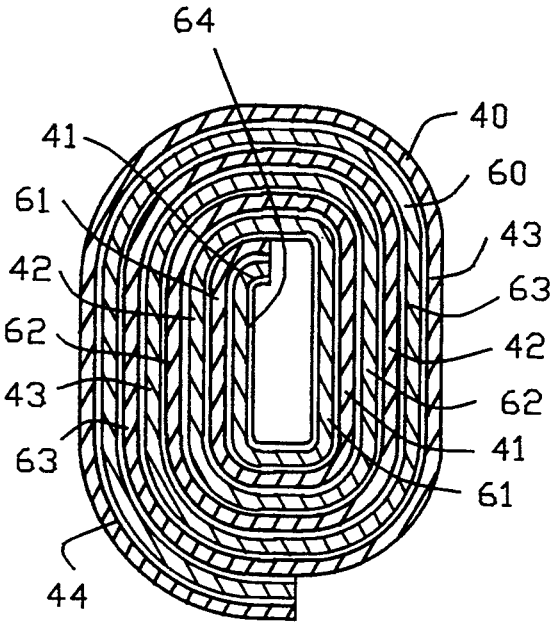
FIG. 18 is a fifth step in the method of fabricating the narrow profile transformer illustrating the removing of the elongated spacer from the winding.

FIG. 18 is a fifth step in the method of fabricating the narrow profile transformer 25A illustrating the removing of the first and second elongated spacers 131 and 132.

Figure 19:
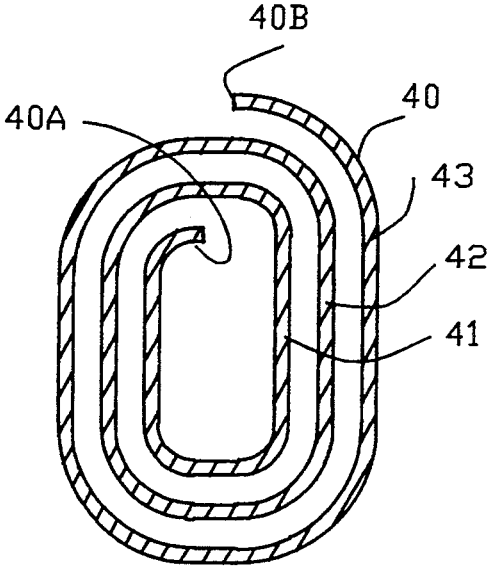
FIG. 19 is a sixth step in the method of fabricating the narrow profile transformer illustrating the primary winding removed and the severing of a distal end of the primary winding.

FIG. 19 is a sixth step in the method of fabricating the narrow profile transformer 25A illustrating the removal of the secondary winding means 40. A distal end 44 of the primary winding means 40 as shown in FIGS. 17 and 18 is severed for defining the second primary end 40B of the primary winding means 40.

Figure 20:
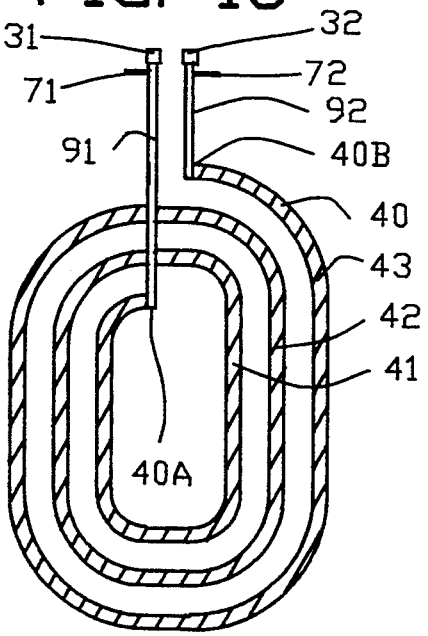
FIG. 20 is a seventh step in the method of fabricating a narrow profile transformer illustrating the connection of the primary winding to input terminals.

FIG. 20 is a seventh step in the method of fabricating the narrow profile transformer 25A illustrating the first and second primary ends 40A and 40B of the primary winding means 40 respectively connected to the first and second input bus bars 91 and 92. A coating of insulation is affixed to the primary winding means 40 preferably by a fluidized bed coating process, electrostatic coating process or the like.

Figure 21:
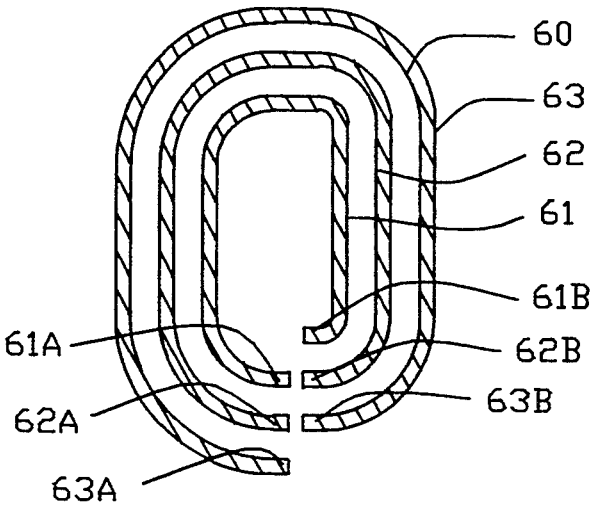
FIG. 21 is an eighth step in the method of fabricating a narrow profile transformer illustrating the secondary winding removed and severed for defining a plurality of secondary turn elements.

FIG. 21 is a eighth step in the method of fabricating a narrow profile transformer illustrating the removal of the secondary winding means 60. A proximal end 60D of the primary winding means 40 as shown in FIGS. 17 and 18 is severed for defining the second secondary turn end 63B and the second secondary end 60B of the primary winding means 40.

Figure 22:
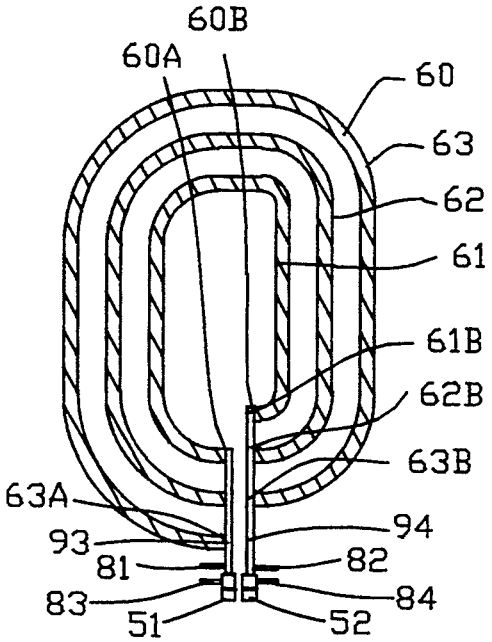
FIG. 22 is a ninth step in the method of fabricating a narrow profile transformer illustrating the connection of the plurality of secondary turn elements to output terminals.

FIG. 22 is a ninth step in the method of fabricating the narrow profile transformer 25A illustrating the interconnection of the first secondary turn ends 61A–63A by the first output bus bar 93 to define a first secondary end 60A. The second secondary turn ends 61B–63B are connected by the second output bus bar 94 to define a second secondary end 60A. The first and second secondary ends 60A and 60B are connected by the first and second output bus bars 93 and 94 to the first and second output terminals 51 and 52. A coating of insulation is affixed to the secondary winding means 60 preferably by a fluidized bed coating process, electrostatic coating process or the like.

Figure 23:
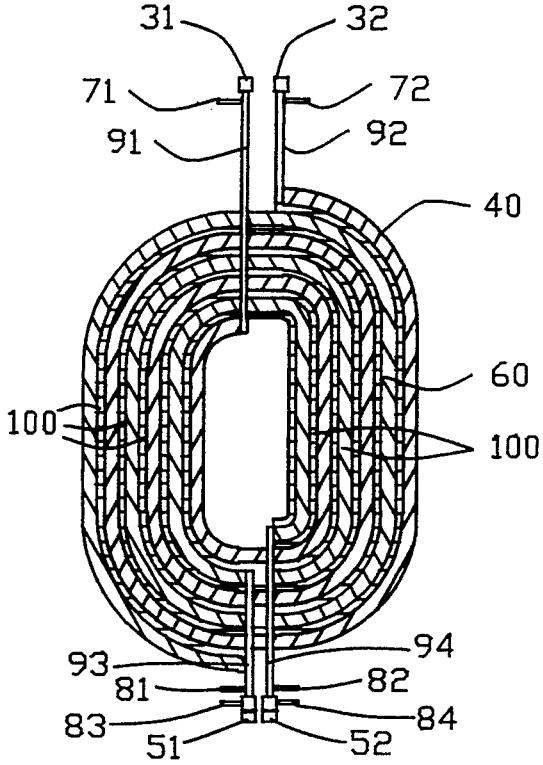
FIG. 23 is a tenth step in the method of fabricating the narrow profile transformer illustrating the reinserting of the secondary winding to be interleaved with the primary winding with an insulation provided therebetween.

FIG. 23 is a tenth step in the method of fabricating the narrow profile transformer illustrating the reinserting of the secondary winding means 60 to be interleaved within the primary winding means 40.

Figure 24:
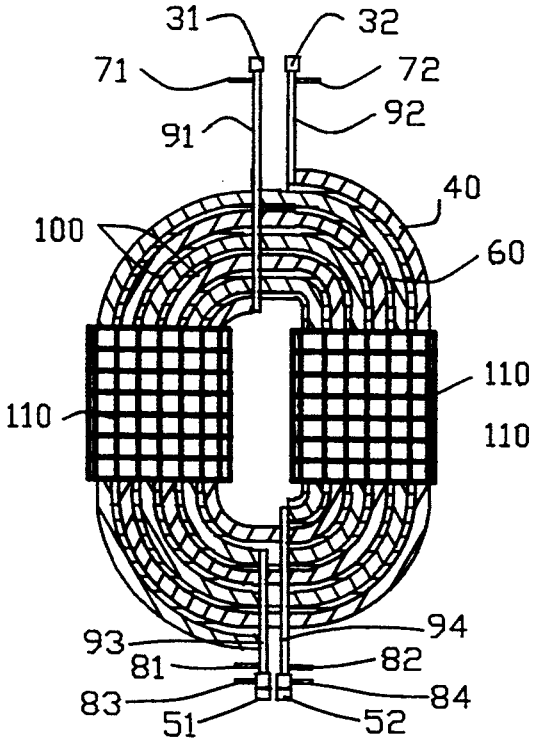
FIG. 24 is an eleventh step in the method of fabricating the narrow profile transformer illustrating the inserting of a core for magnetically coupling the primary and the secondary windings.

FIG. 24 is an eleventh step in the method of fabricating the narrow profile transformer 25A illustrating the inserting of the transformer core 110 for magnetically coupling the primary and the secondary winding means 40 and 60. Preferably, the transformer core 110 comprises a ferrite core 110 to reduce the losses in the ferrite core 110 relative to other types of core material. The ferrite cores 110 is located in close proximity to the primary and secondary winding means 40 and 60 to cool the ferrite core 110 with the primary and secondary fluid passages 76 and 86 thus eliminating the need to direct cool the ferrite core 110. The ferrite core 110 may be made by gluing ferrite bars of various shape together to form the ferrite core 110. Ferrite bars in the size of 1.0 inch by 1.0 inch by 4.0 inches have been found to provide desired results.

Figure 25:
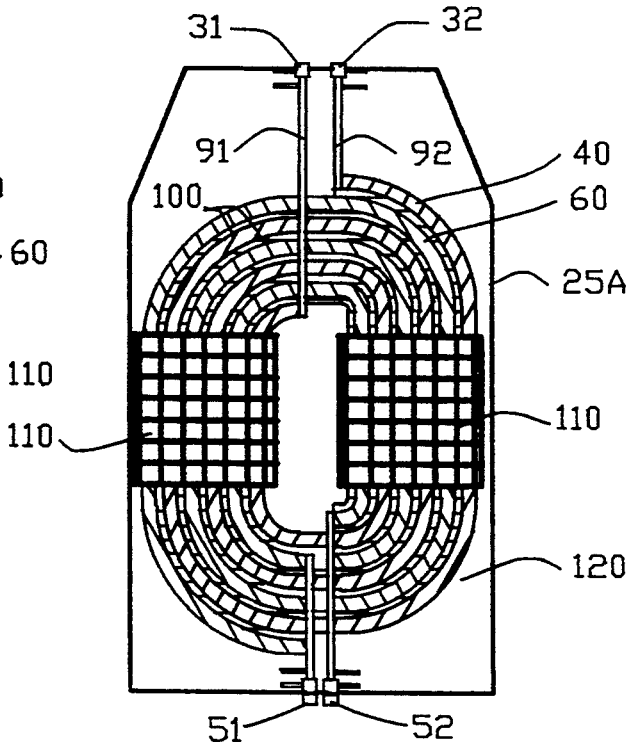
FIG. 25 is a twelfth step in the method of fabricating the narrow profile transformer illustrating the encapsulation of the primary and secondary windings with a polymeric material.

FIG. 25 is a twelfth step in the method of fabricating the narrow profile transformer 25A illustrating the total encapsulation of the primary and secondary windings 40 and 60 with the polymeric material 120. The encapsulation by the polymeric material 120 secures the secondary winding means 60 relative to the primary winding means 40. The encapsulation by the polymeric material 120 also provides means for mounting the narrow profile transformer 25A.

Figure 26:
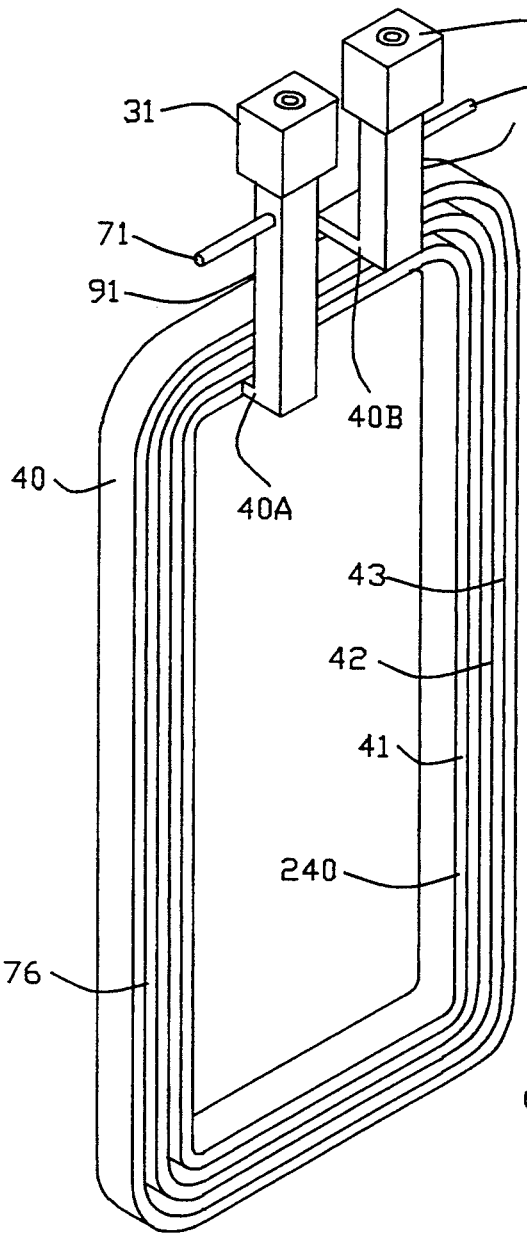
FIG. 26 is an isometric view of the primary winding of the narrow profile transformer illustrating fluid cooling paths for the primary winding.

FIG. 26 is an isometric view of the primary winding 40 of the narrow profile transformer 25A illustrating the primary fluid cooling path 76 for the primary winding 40. The primary winding means 40 comprises a primary metallic conducting tube means defining the primary fluid passage 76 within the primary metallic conducting tube means 240. The primary metallic conducting tube means 240 are generally rectangular in cross-section.

Figure 27:
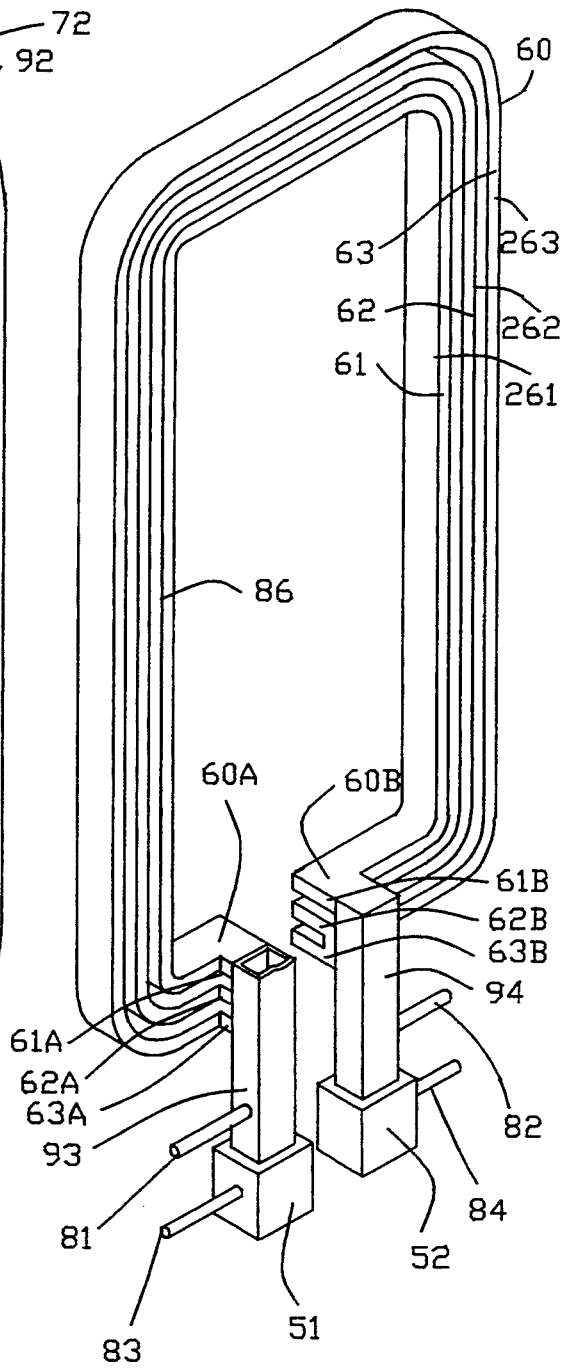
FIG. 27 is an isometric view of the secondary winding of the narrow profile transformer illustrating fluid cooling paths for the secondary winding.

FIG. 27 is an isometric view of the secondary winding 60 of the narrow profile transformer 25A illustrating the secondary fluid cooling path 86 for the secondary winding 40. The secondary winding means 60 comprising secondary metallic conducting tube means 260 defining the secondary fluid passage 86 within the secondary metallic conducting tube means 260. The secondary winding means 60 comprises a plurality of secondary metallic conducting tube means 261–262 each defining a secondary liquid passage within the secondary metallic conducting tube means 260. The plurality of secondary metallic conducting tube means 261–262 are interconnected for defining the continuous secondary fluid passage 86 therein. The secondary metallic conducting tube means 261–263 are generally rectangular in cross-section.

The primary and secondary metallic conducting tube means 240 and 260 are connected to a source of flowing fluid for cooling the improved narrow profile transformer 25A thereby. Preferably, primary and secondary metallic conducting tube means may comprise a hollow copper tubing having either a round, square, or rectangular cross-sectional configuration. In this example, primary and secondary metallic conducting tube means 240 and 260 are shown as rectangular tubes having a height of 0.25 inches and a width of 0.75 inches and a wall thickness of 0.048 inches.

The first and second input bus bars 91 and 92 comprise hollow bus bars and are braised to the primary metallic conducting tube means 240 for providing fluid communication therebetween. The primary cooling tubes 71 and 72 are connected to the first and second input bus bars 91 and 92 to defined the primary fluid path 76. The primary fluid path 76 extend from the first primary cooling tube 71 through the first, second and third primary turn means 41–43 to the second primary cooling tube 72 as shown by the arrows. The continuous and series primary fluid path 76 insures an equal flow through the first, second and third primary turn means 41–43.

In a similar manner, the first and second output bus bars 93 and 94 comprise hollow bus bars and are braised to the secondary metallic conducting tube means 261–263 for providing fluid pathway therebetween. The secondary cooling tubes 81 and 82 are connected to the first and second output bus bars 93 and 94 to defined the secondary fluid path 86. The secondary fluid path 86 extends in series from the first secondary cooling tube 81 through the first, second and third secondary turn means 61–63 to the second secondary cooling tube 82 as shown by the arrows. The continuous and series secondary fluid path 86 insures an equal flow through the first, second and third secondary turn means 61–63. The secondary fluid flow path 86 through the first, second and third secondary turn means 61–63 is connected in series whereas the first, second and third secondary turn means 61–63 are connected in electrical parallel.

The secondary cooling tubes 83 and 84 are connected to the first and second output bus bars 93 and 94 to defined a load fluid path 87. The load fluid path 87 extends in series from the third secondary cooling tube 83 through the quick clamping connector 53 and through the electrical load 28A as shown in FIG. 3. The load fluid path 87 continues from the electrical load 28A through the quick clamping connector 54 to the fourth secondary cooling tube 84. The load fluid path 87 provides a separate cooling path for the electrical load 28A. The primary fluid path 76, the secondary fluid flow path 86 insures that all portions of current carrying conductors are cooled by a fluid flow path.

The narrow profile transformer 25A of the present invention has many advantages over the narrow profile transformer of the prior art. In the prior art narrow profile transformers, the primary and secondary windings are arranged in a side by side relationship with insulation barriers interposed between the primary and secondary windings. The insulation barriers interposed between the primary and secondary windings in the prior art transformers increase the leakage inductance, increase the winding resistance and increase the overall width of the narrow profile transformer.

In the narrow profile transformer 25A of the present invention, the primary and secondary windings 40 and 60 are interleaved to minimize the leakage inductance. In addition, the interleaved the primary and secondary windings 40 and 60 enables the current to flow on both sides of the primary and secondary metallic conducting tube means 240 and 261–263 in contrast to the flow of current on only one side of the primary and secondary winding of the prior art transformers. The flow of current on both sides of the primary and secondary metallic conducting tube means 240 and 261–263 in the present invention reduces the overall resistance of the present invention relative to the prior art transformers. The interleaved primary and secondary windings 40 and 60 enables the narrow profile transformer 25A of the present invention provides a transformer narrower than heretofore know in the prior art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. The method of forming an improved narrow profile transformer, comprising the steps of:

positioning an elongated spacer between a primary winding material and a secondary winding material;

spirally winding the primary winding material, the elongated spacer and the secondary winding material within a geometric plane to form a primary winding means from said primary winding material and to form a secondary winding means from the secondary winding material with the secondary winding means being interleaved with the primary winding means;

removing the elongated spacer;

removing the secondary winding means;

severing the secondary winding means to form a plurality of secondary turn means;

connecting the plurality of secondary turn means to form said secondary turn means;

connecting input connection means to the primary winding means;

connecting output connection means to the secondary winding means;

providing an insulation between the primary winding means and the secondary winding means;

inserting the secondary winding means into the primary winding means with the secondary winding means being interleaved within the primary winding means; and securing the secondary winding means relative to the primary winding means.

2. The method of forming an improved narrow profile transformer as set forth in claim 1, wherein the step of spirally winding the primary winding material, the elongated spacer and the secondary winding material within a geometric plane includes spirally winding the elongated spacer and the secondary winding material radially outwardly such that all portions of the elongated spacer and the secondary winding material intersect the geometric plane extending through the improved narrow profile transformer.

3. The method of forming an improved narrow profile transformer as set forth in claim 1, wherein the step of connecting the plurality of secondary turn means to form said secondary turn means includes interconnecting the plurality of secondary turn elements in a parallel relationship.

4. The method of forming an improved narrow profile transformer as set forth in claim 1, wherein the step of providing an insulation between the primary winding means and the secondary winding means includes affixing a polymeric coating to at least one of the primary winding means and the secondary winding means.

5. The method of forming an improved narrow profile transformer as set forth in claim 1, wherein the step of securing the secondary winding means relative to the primary winding means includes encapsulating the primary and secondary winding means within a polymeric material.

* * * * *